US006709243B1

(12) United States Patent
Tan et al.

(10) Patent No.: US 6,709,243 B1
(45) Date of Patent: Mar. 23, 2004

(54) ROTARY MACHINE WITH REDUCED AXIAL THRUST LOADS

(75) Inventors: Rubin Tan, Canoga Park, CA (US); Gary Willard, Woodland Hills, CA (US); Robert W. Bosley, Cerritos, CA (US)

(73) Assignee: Capstone Turbine Corporation, Chatsworth, CA (US)

( * ) Notice: Subject to any disclaimer, the term of this patent is extended or adjusted under 35 U.S.C. 154(b) by 0 days.

(21) Appl. No.: 09/696,316

(22) Filed: Oct. 25, 2000

(51) Int. Cl.[7] ..... F04B 3/00

(52) U.S. Cl. ..... 417/244; 417/423.1; 417/423.7; 415/55.1; 415/55.2

(58) Field of Search ..... 417/423.1, 423.7, 417/244, 423.12, 423.14; 415/55.1, 55.2

(56) References Cited

U.S. PATENT DOCUMENTS 5,265,997 A * 11/1993 Tuckey ..... 415/55.1
5,525,048 A * 6/1996 Tuckey ..... 417/423.15
5,680,700 A * 10/1997 Tuckey ..... 29/888.02
5,702,229 A * 12/1997 Moss et al. ..... 415/55.4
5,795,138 A * 8/1998 Gozdawa ..... 417/243
5,899,673 A * 5/1999 Bosley et al. ..... 417/423.14
6,113,363 A * 9/2000 Talaski ..... 417/423.3
6,280,090 B1 * 8/2001 Stephens et al. ..... 384/284

* cited by examiner

*Primary Examiner*—Charles G. Freay
*Assistant Examiner*—William H. Rodriguez
(74) *Attorney, Agent, or Firm*—Sterne, Kessler, Goldstein & Fox P.L.L.C.

(57) ABSTRACT

A rotary machine includes a helical flow compressor/turbine and a permanent magnet motor/generator including a housing with a stator positioned therein. A shaft is rotatably supported within the housing. A permanent magnet rotor is mounted on a shaft and operatively associated with the stator. An impeller is mounted on the shaft and includes an impeller disk with a plurality of impeller blades extending therefrom. The housing includes a generally horseshoe-shaped fluid flow stator channel with an inlet at a first end and an outlet at a second end. The fluid in the generally horseshoe-shaped fluid flow stator channel proceeds from the inlet to the outlet while following a generally helical flow path with multiple passes through the impeller blades. The impeller disk has a plurality of axially-oriented vent holes formed therethrough to minimize a pressure differential across the impeller, thereby minimizing thrust loads applied to the impeller.

42 Claims, 10 Drawing Sheets

ROTARY MACHINE WITH REDUCED AXIAL THRUST LOADS

TECHNICAL FIELD

The present invention relates to an improved helical flow compressor design modified so as to produce very low bearing thrust loads without a loss in efficiency.

BACKGROUND ART

A helical flow compressor is a high-speed rotary machine that accomplishes compression by imparting a velocity head to each fluid particle as it passes through the machine's impeller blades then converting that velocity head into a pressure head in a stator channel that functions as a vaneless diffuser. While in this respect a helical flow compressor has some characteristics in common with a centrifugal compressor, the primary flow in a helical flow compressor is peripheral and asymmetrical, while in a centrifugal compressor, the primary flow is radial and symmetrical. The fluid particles passing through a helical flow compressor travel around the periphery of the helical flow compressor impeller within a generally horseshoe-shaped stator channel. Within this channel, the fluid particles travel along helical streamlines, the centerline of the helix coinciding with the center of the curved stator channel. This flow pattern causes each fluid particle to pass through the impeller blades or buckets many times while it travels through the helical flow compressor, each time acquiring kinetic energy. After each pass through the impeller blades, the fluid particle reenters the adjacent stator channel where it converts its kinetic energy into potential energy which, in turn, produces a peripheral pressure gradient in the stator channel.

The multiple passes through the impeller blades (regenerative flow pattern) allows a helical flow compressor to produce discharge heads of up to fifteen (15) times those produced by a centrifugal compressor operating at equal tip speeds. Since the cross-sectional area of the peripheral flow in a helical flow compressor is usually smaller than the cross-sectional area of the radial flow in a centrifugal compressor, a helical flow compressor would normally operate at flows which are lower than the flows of a centrifugal compressor having an equal impeller diameter and operating at an equal tip speed. The high-head, low-flow performance characteristics of a helical flow compressor make it well suited to a number of applications where a reciprocating compressor, a rotary displacement compressor, or a low specific-speed centrifugal compressor would not be as well suited.

A helical flow compressor can be utilized as a turbine by supplying it with a high pressure working fluid, dropping fluid pressure through the machine, and extracting the resulting shaft horsepower with a generator. Hence the term "compressor/turbine" which is used throughout this application.

The flow in a helical flow compressor can be visualized as two fluid streams which first merge and then divide as they pass through the compressor. One fluid stream travels within the impeller buckets and endlessly circles the compressor. The second fluid stream enters the compressor radially through the inlet port and then moves into the horseshoe-shaped stator channel which is adjacent to the impeller buckets. Here the fluids in the two streams merge and mix. The stator channel and impeller bucket streams continue to exchange fluid while the stator channel fluid stream is drawn around the compressor by the impeller motion. When the stator channel fluid stream has traveled around most of the compressor periphery, its further circular travel is blocked by the stripper plate. The stator channel fluid stream then turns radially outward and exits from the compressor through the discharge port. The remaining impeller bucket fluid stream passes through the stripper plate within the buckets and merges with the fluid just entering the compressor/turbine.

The fluid in the impeller buckets of a helical flow compressor travels around the compressor at a peripheral velocity which is essentially equal to the impeller blade velocity. It thus experiences a strong centrifugal force which tends to drive it radially outward, out of the buckets. The fluid in the adjacent stator channel travels at an average peripheral velocity of between five (5) and ninety-nine (99) percent of the impeller blade velocity depending upon the compressor discharge flow. It thus experiences a centrifugal force which is much less than that experienced by the fluid in the impeller buckets. Since these two centrifugal forces oppose each other and are unequal, the fluid occupying the impeller buckets and the stator channel is driven into a circulating or regenerative flow. The fluid in the impeller buckets is driven radially outward and "upward" into the stator channel. The fluid in the stator channel is displaced and forced radially inward and "downward" into the impeller bucket.

The fluid in the impeller buckets of a helical flow turbine travels around the turbine at a peripheral velocity which is essentially equal to the impeller blade velocity. It thus experiences a strong centrifugal force which would like to drive it radially outward if unopposed by other forces. The fluid in the adjacent stator channel travels at an average peripheral velocity of between one hundred and one percent (101%) and two hundred percent (200%) of the impeller blade velocity, depending upon the turbine discharge flow. It thus experiences a centrifugal force which is much greater than that experienced by the fluid in the impeller buckets. Since these two centrifugal forces oppose each other and are unequal, the fluid occupying the impeller buckets and the stator channel is driven into a circulating or regenerative flow. The fluid in the stator channel is driven radially outward and "downward" into the impeller bucket. The fluid in the impeller buckets is displaced and forced radially inward and "upward" into the stator channel.

While the fluid is traveling regeneratively, it is also traveling peripherally around the stator-impeller channel. Thus, each fluid particle passing through a helical flow compressor or turbine travels along a helical streamline, the centerline of the helix coinciding with the center of the generally horseshoe-shaped stator-impeller channel. While the unique capabilities of a helical flow compressor would seem to offer many applications, the low flow limitation has severely curtailed their widespread utilization.

Permanent magnet motors and generators, on the other hand, are used widely in many and varied applications. This type of motor/generator has a stationary field coil and a rotatable armature of permanent magnets. In recent years, high energy product permanent magnets having significant energy increases have become available. Samarium cobalt permanent magnets having an energy product of twenty-seven (27) megagauss-oersted (mgo) are now readily available and neodymium-iron-boron magnets with an energy product of thirty-five (35) megagauss-oersted are also available. Even further increases of mgo to over 45 megagauss-oersted promise to be available soon. The use of such high energy product permanent magnets permits increasingly smaller machines capable of supplying increasingly higher power outputs. The permanent magnet rotor may comprise a plurality of equally spaced magnetic poles of alternating polarity or may even be a sintered one-piece magnet with radial orientation. The stator would normally include a plurality of windings producing rotatable electro-magnet poles of alternating polarity. In a generator mode, rotation of the rotor causes the permanent magnets to pass by the stator poles and coils and thereby induces an electric current to flow in each of the coils. In the motor mode, alternating electrical current is passed through the coils which will cause the permanent magnet rotor to rotate.

U.S. Pat. No. 5,899,673 provides an example of a helical flow compressor/turbine integrated with a permanent magnet motor/generator, and is hereby incorporated by reference in its entirety.

In a multi-stage helical flow compressor, multiple impellers are arranged along a common shaft to achieve a desired pressure rise. The impeller wheels are generally very thin and relatively large in diameter. If there is any leakage of pressurized fluid between compression stages, such as through the radial gap between the rotating impeller spacer rings and the compressor housing, a pressure differential will develop across the impeller wheel in each stage. Each stage's pressure differential, acting on the large area of the impeller wheel, applies a thrust load to the compressor shaft. The thrust loads generated in each stage are cumulative, normally resulting in high thrust loads being applied to the bearings supporting the compressor shaft and impeller wheels. These loads may induce unwanted bearing deflections, wheel rubbing and bearing damage or failure. These problems may occur in single-stage or multi-stage helical flow compressors.

Accordingly, it is desirable to provide an improved helical flow compressor wherein thrust loads applied to the impeller(s) are minimized.

DISCLOSURE OF INVENTION

The present invention provides an improved helical flow compressor wherein thrust loads applied to the impeller(s) are minimized in various embodiments of the invention by providing axially oriented vent holes through the impeller(s), eliminating the radial flow splitter, providing labyrinth seals between adjacent impellers and between the motor cavity and the impeller adjacent to it, as well as by providing at least one bypass vent around the shaft support bearing adjacent to the motor cavity.

More specifically, in a preferred embodiment, the present invention provides a rotary machine including a helical flow compressor/turbine and a permanent magnet motor/generator mounted and operated within a common housing. A shaft is rotatably supported within the housing. A permanent magnet rotor is mounted on the shaft and operatively associated with the motor/generator stator. Disk shaped impeller wheels are mounted on the shaft each having a plurality of impeller blades extending therefrom. The compressor/turbine section of the housing includes a generally horseshoe-shaped fluid flow stator channel on each side of each impeller wheel with an inlet at a first end and an outlet at a second end for each wheel/stage. The fluid in each generally horseshoe-shaped fluid flow stator channel proceeds from the inlet to the outlet while following a generally helical flow path with multiple passes through the impeller blades. Each impeller disk has a plurality of axially-oriented vent holes formed therethrough to minimize a pressure differential across the impeller, thereby minimizing thrust loads applied to the impeller.

The vent holes in the impeller disk are preferably chamfered to reduce local pressure drop where fluid enters or exits the holes. A ratio of hole diameter to outer chamfer diameter is optimized based on the axial clearance between the impeller disk and the adjacent housing so as to minimize flow restrictions and minimize vent hole volume.

The commonly-used radial flow splitter, such as that described in U.S. Pat. No. 5,899,673, is eliminated from the housing adjacent the periphery of the impeller blades, thereby providing a radial gap between the periphery of the impeller blades and the housing to allow increased axial flow around the periphery of the impeller blades to further minimize the pressure differential across the impeller.

In one embodiment, the shaft is supported by ball bearings, and at least one bypass vent is formed through the housing around the ball bearing closest to the large gas storage volume of the motor in order to provide fluid communication between opposing sides of the bearing which minimizes the flow of contaminant-laden gas through the bearing.

In a multi-stage helical flow compressor, a labyrinth seal is disposed between any or all adjacent impellers to minimize leakage between impellers, thereby decreasing thrust loads on the impellers. (For example, there would be three seals for four impeller wheel/disks.)

Accordingly, it is a principal object of the invention to provide an improved helical flow compressor wherein thrust loads applied to the impeller(s) are minimized.

It is another object of the invention to provide a helical flow compressor having features which reduce the thrust load applied to the compressor's shaft by the impeller wheels and to the compressor's bearings by the compressor shaft.

It is another object of the invention to provide a helical flow compressor with decreased pressure differentials across its impeller wheels by decreasing restrictions for axial flow of fluid through or around each impeller wheel, and increasing restrictions for axial flow of fluid between the impeller wheels.

It is yet another object of the invention to provide a helical flow compressor with a pattern of axially-oriented vent holes that pass through the compressor's impeller wheels in order to reduce the pressure differential across the wheel and reduce the thrust load applied to the wheel, shaft, and bearings.

It is still another object of the invention to provide a helical flow compressor with a pattern of axially-oriented vent holes passing through the compressor's impeller wheels, with chamfers provided for each of the holes where the holes meet the surfaces of the wheel in order to reduce the local pressure drop where the flow enters or exits the holes.

It is another object of the present invention to provide a helical flow compressor with a pattern axially-oriented vent holes with chamfers wherein the ratio of the hole diameter to the outer chamfer diameter is optimized to minimize flow restrictions and minimize vent hole/chamfer volume.

Still further, it is another object of the invention to provide a helical flow compressor with an increased axial flow area radially outboard of the impeller wheel and radially inboard of the housing by deleting the radial flow splitter which normally occupies the entire periphery of the pump, except in the area of the flow stripper.

It is yet another object of the invention to provide a helical flow compressor wherein vent holes, vent chamfers, and the elimination of the radial flow splitter combine to minimize the flow restriction from one side of an impeller wheel to the other side.

It is another object of the present invention to provide a helical flow compressor wherein labyrinth seals are located between the impeller wheels to minimize leakage between compressor stages, thereby minimizing the thrust load applied to the wheels, the shaft, and the bearings.

It is a further object of the invention to provide a helical flow compressor wherein decreasing axial flow restrictions for each wheel with vent holes, vent chamfers, and the elimination of the radial flow splitter combined with increasing axial flow restrictions between adjacent wheels with labyrinth seals minimizes the pressure differentials across the impeller wheels and thus minimizes the thrust load applied to the wheels, the shaft, and the bearings.

It is a further object to provide a helical flow compressor impeller with axial vent holes which are smaller at outer row(s) to limit swept through volume penalties at the stripper plate location.

It is another object of the invention to provide a helical flow compressor wherein axial flow restrictions are decreased across the bearing adjacent to the motor by providing vent holes around the bearing to minimize the undesired flow of fluid through the bearing.

It is a further object to provide a helical flow compressor with a labyrinth seal between the motor cavity (on either side of the bearing) and adjacent the impeller wheels.

The above objects and other objects, features, and advantages of the present invention are readily apparent from the following detailed description of the best mode for carrying out the invention when taken in connection with the accompanying drawings.

BRIEF DESCRIPTION OF DRAWINGS

Figure 1:
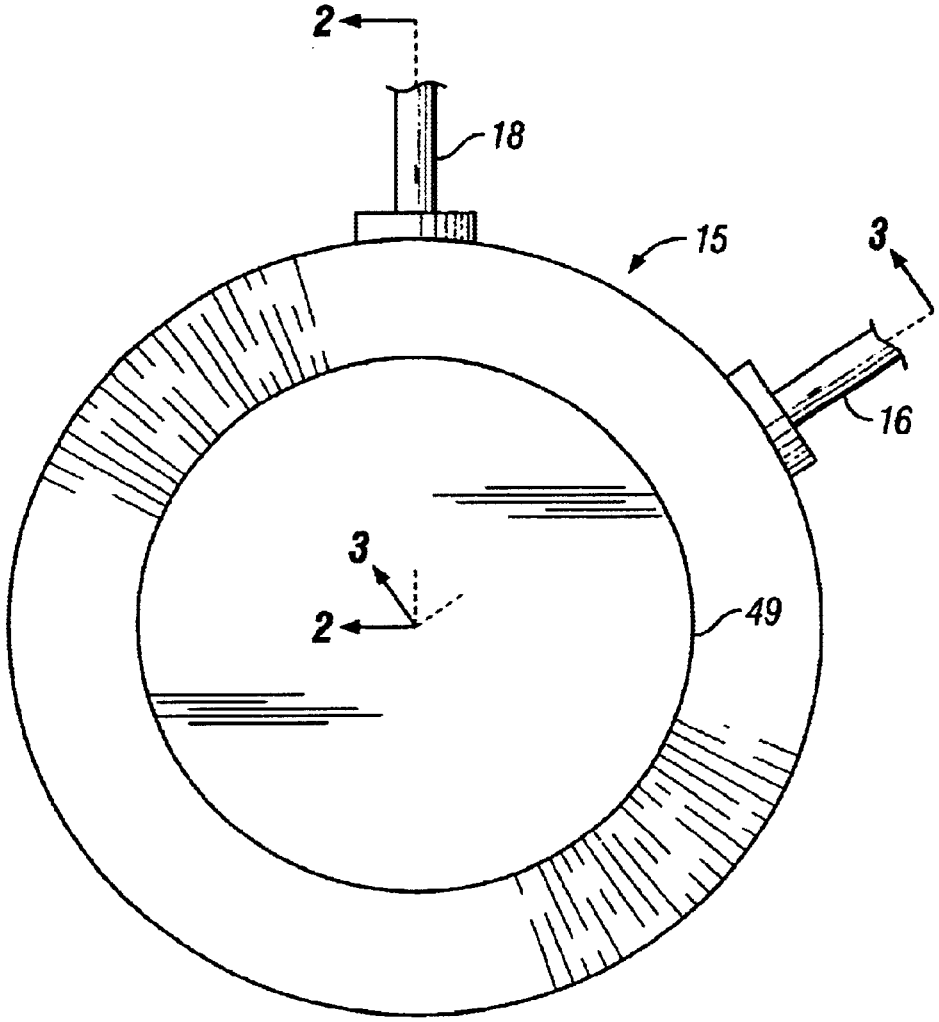
Figure 2:
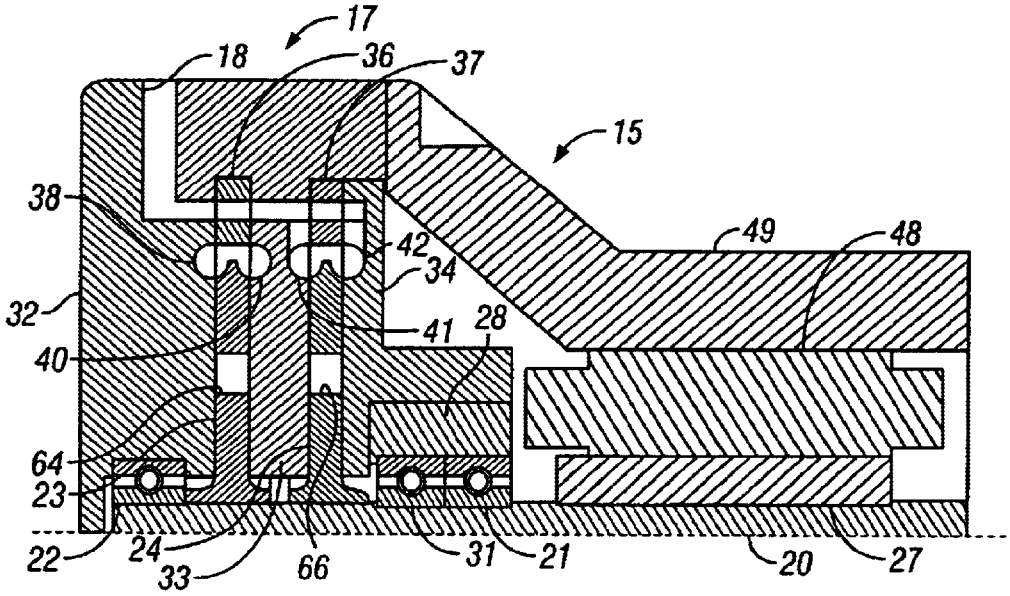
Figure 3:
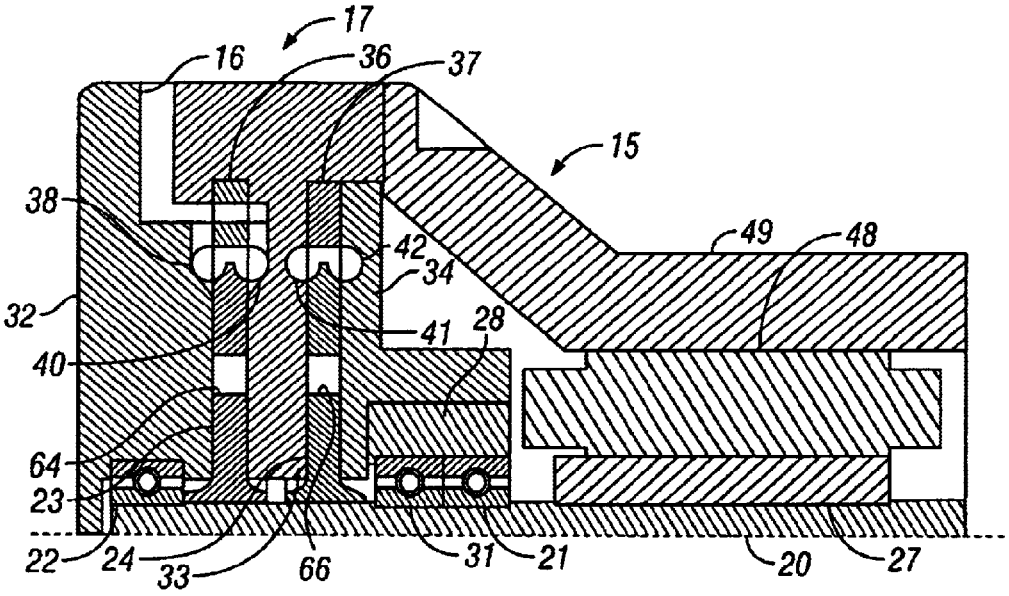
Figure 4:
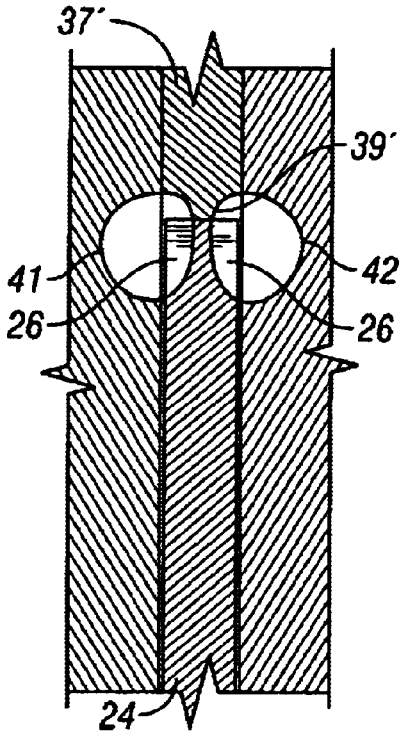
FIG. 4 (Prior Art)
Figure 5:
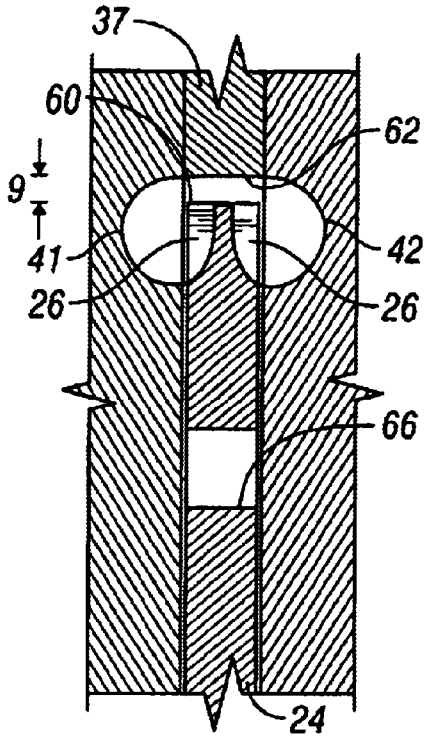
Figure 6:
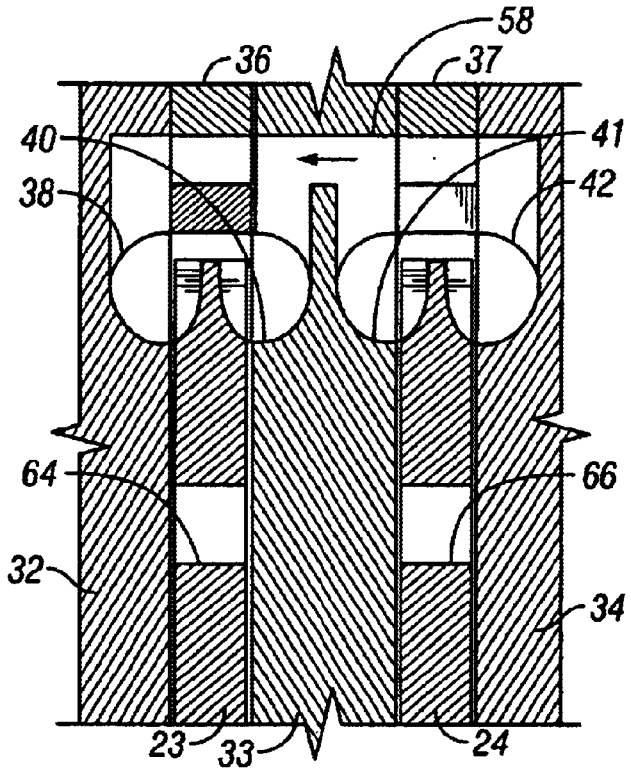
Figure 7:
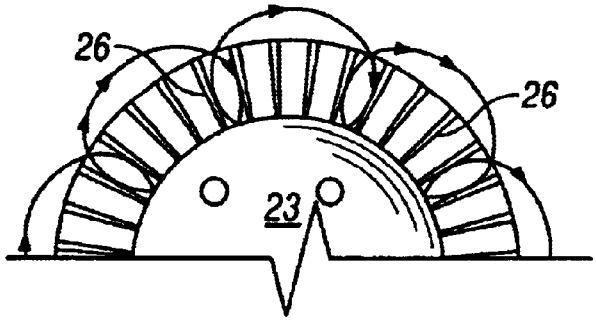
Figure 8:
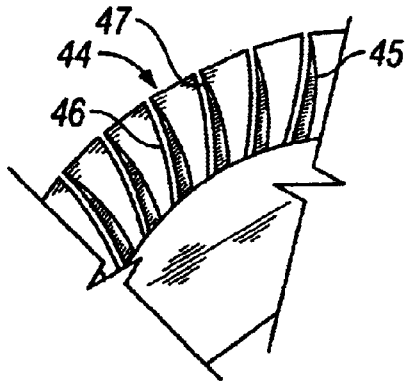
Figure 9:
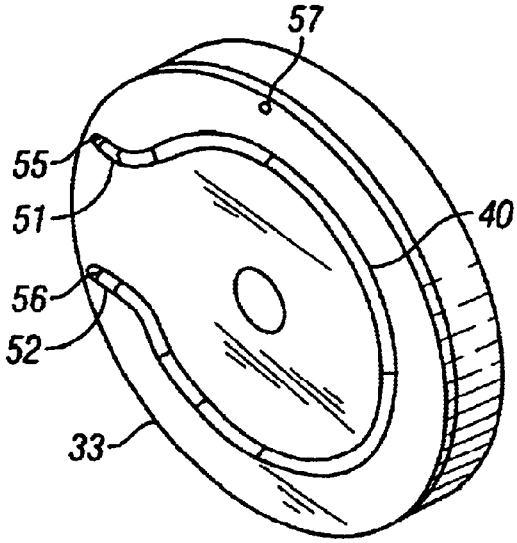
Figure 10:
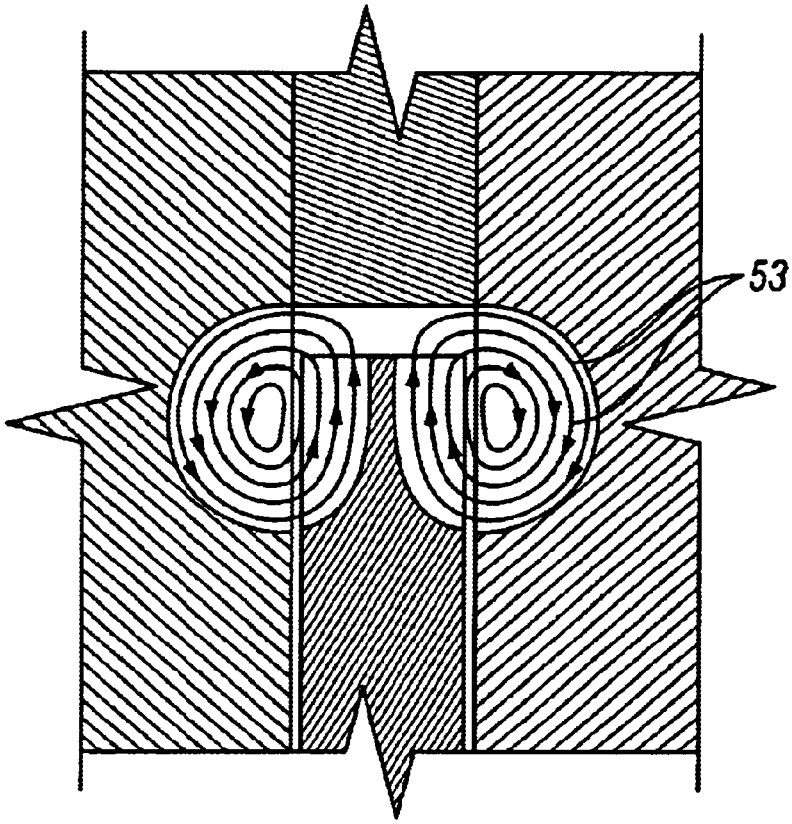
Figure 11:
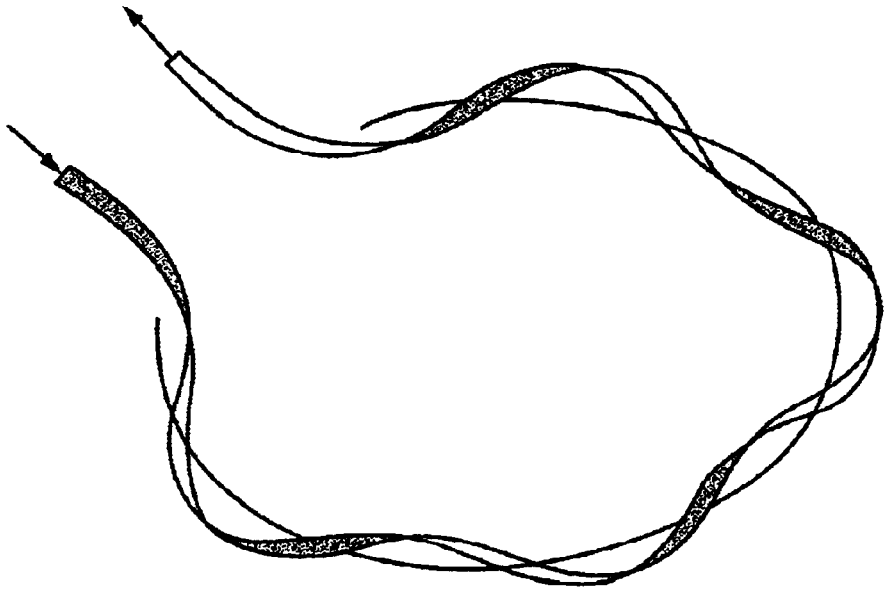
Figure 14:
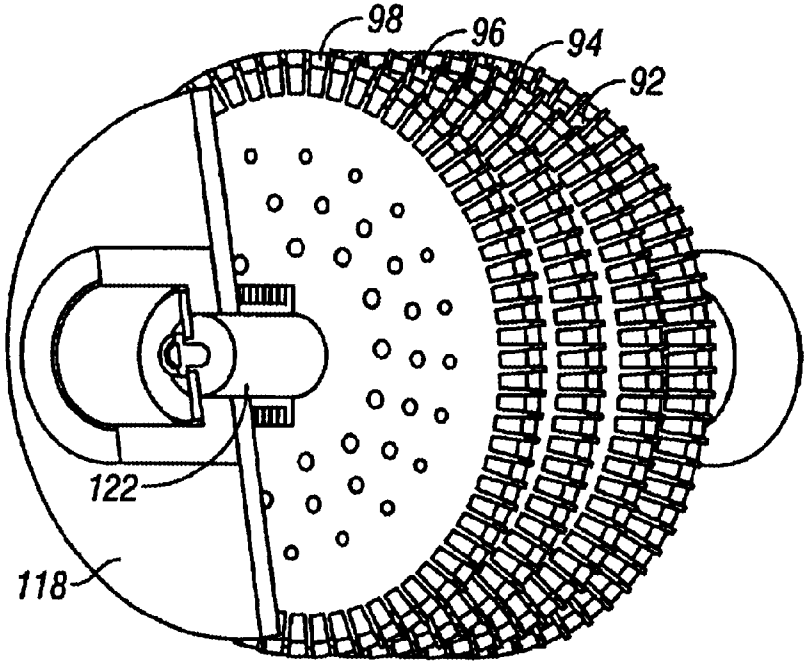
Figure 12:
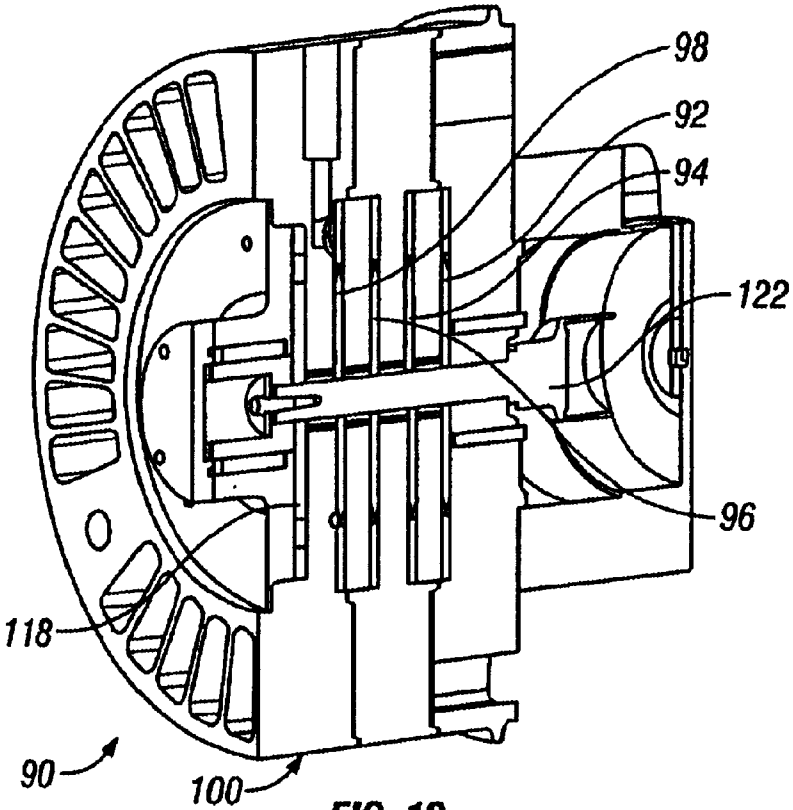
Figure 13:
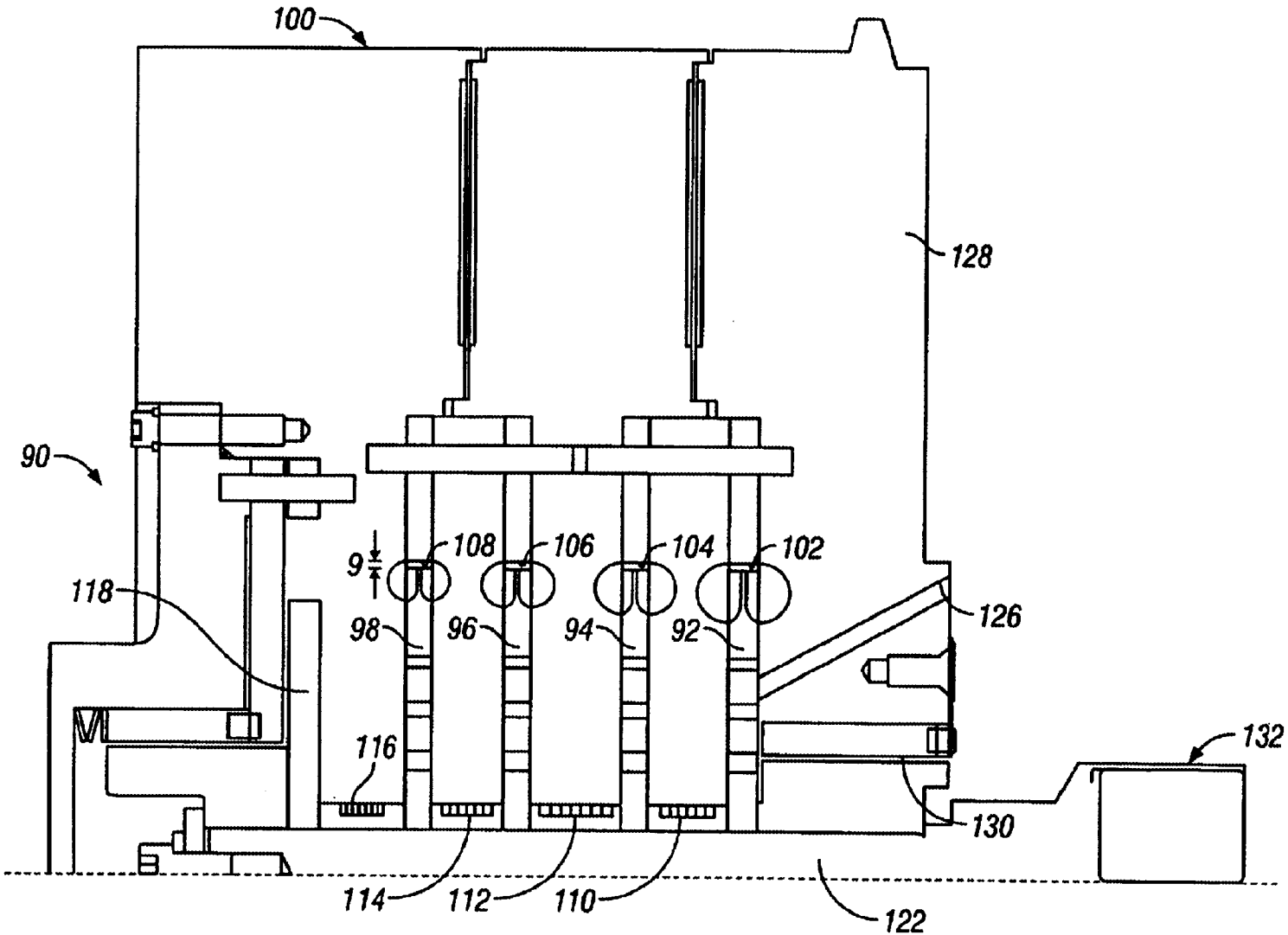
Figure 15:
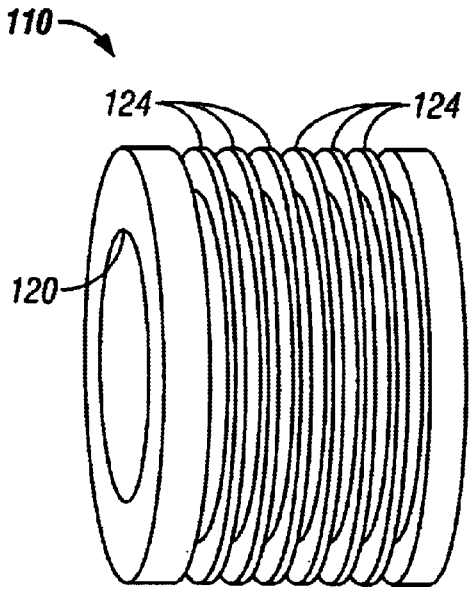
Figure 19:
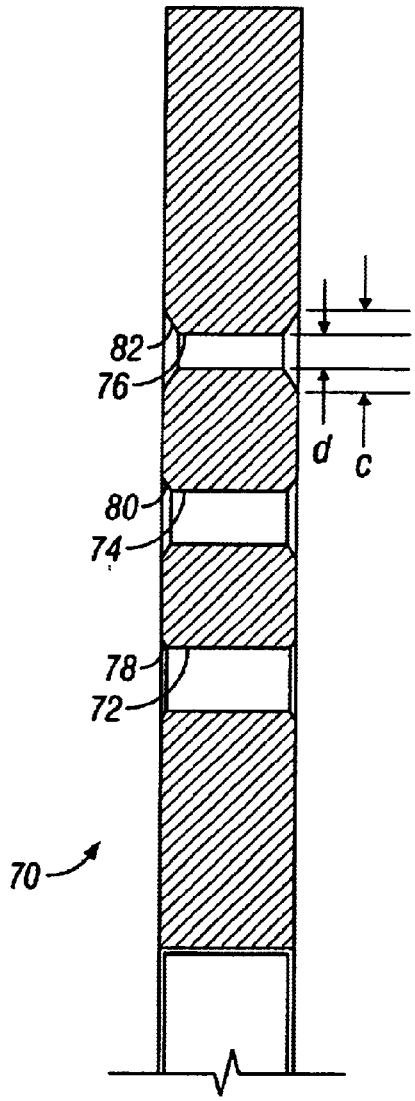
Figure 16:
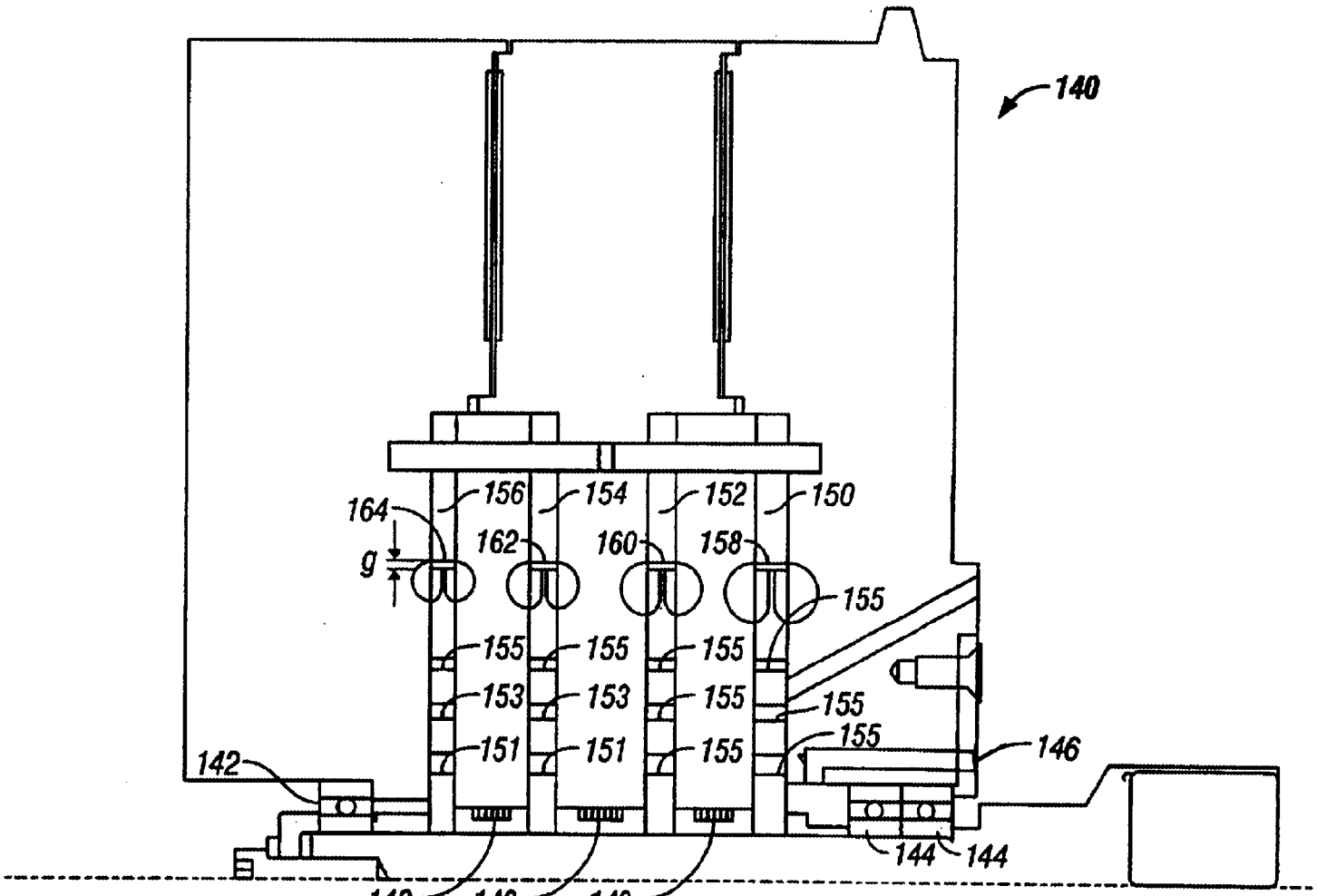
Figure 17:
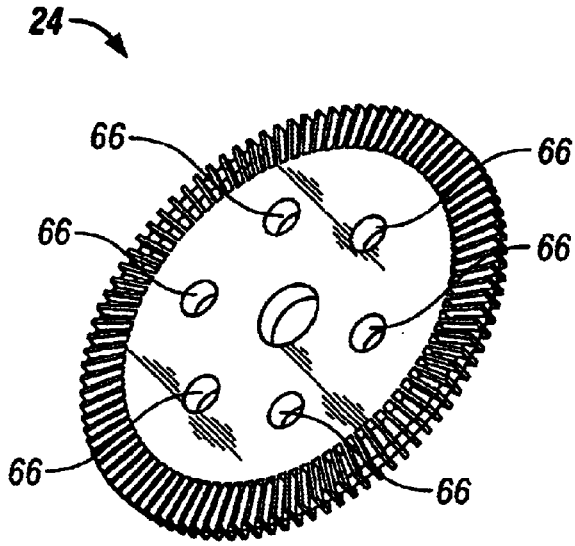
Figure 18:
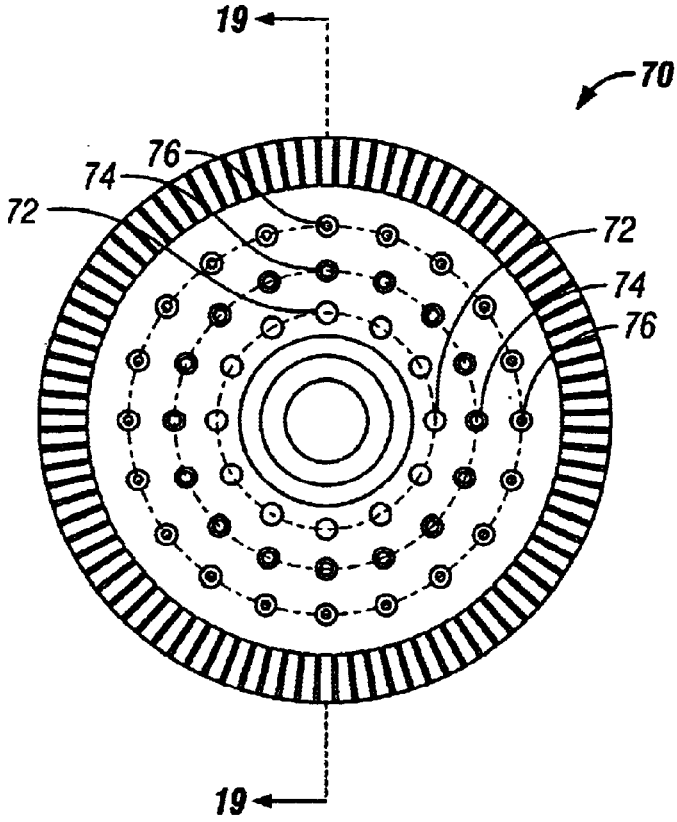

Having thus described the present invention in general terms, reference will now be made to the accompanying drawings in which:

FIG. 1 is an end view of a two-stage helical flow compressor/turbine permanent magnet motor/generator of the present invention;

FIG. 2 is a cross-sectional view of the helical flow compressor/turbine permanent magnet motor/generator of FIG. 1 taken along line 2—2;

FIG. 3 is a cross-sectional view of the helical flow compressor/turbine permanent magnet motor/generator of FIG. 1 taken along line 3—3;

FIG. 4 is an enlarged sectional view of a portion of the low pressure stage of a prior art helical flow compressor/turbine permanent magnet motor/generator;

FIG. 5 is an enlarged sectional view of a portion of the low pressure stage of the helical flow compressor/turbine permanent magnet motor/generator of FIG. 3;

FIG. 6 is an enlarged sectional view of the helical flow compressor/turbine permanent magnet motor/generator of FIGS. 1–3 illustrating the cross-over of fluid from the low pressure stage to the high pressure stage;

FIG. 7 is an enlarged schematically-arranged partial plan view of the helical flow compressor/turbine impeller having straight radial blades and illustrating the flow of fluid therethrough;

FIG. 8 is an enlarged partial plan view of a helical flow compressor/turbine impeller having curved blades;

FIG. 9 is an exploded perspective view of a stator channel plate of the helical flow compressor/turbine permanent magnet motor/generator of FIGS. 1–3;

FIG. 10 is an enlarged sectional view of a portion of FIG. 2 illustrating fluid flow streamlines in the impeller blades and fluid flow stator channels;

FIG. 11 is a schematic representation of the flow of fluid through a helical flow compressor/turbine;

FIG. 12 is a cut-away perspective view of a partially disassembled four-stage helical flow compressor/turbine permanent magnet motor/generator in accordance with a second embodiment of the invention;

FIG. 13 is a longitudinal cross-sectional view of the four-stage helical flow compressor/turbine permanent magnet motor/generator of FIG. 12;

FIG. 14 is a partially cut-away, partially disassembled perspective view of a thrust disk, shaft, and a plurality of impellers corresponding with the embodiment of FIG. 12;

FIG. 15 shows a perspective view of a labyrinth seal in accordance with the embodiment of FIG. 12;

FIG. 16 shows a longitudinal cross-sectional view of a four-stage helical flow compressor/turbine permanent magnet motor/generator in accordance with a third embodiment of the invention;

FIG. 17 shows a perspective view of an impeller in accordance with the invention;

FIG. 18 shows a plan view of an alternative impeller in accordance with the invention; and FIG. 19 shows a partial cross-sectional view of the impeller of FIG. 18.

DETAILED DESCRIPTION OF THE PREFERRED EMBODIMENTS

A two-stage helical flow compressor/turbine permanent magnet motor/generator 15 is illustrated in FIGS. 1–3 and includes a fluid inlet 18 to provide fluid to the helical flow compressor/turbine 17 of the helical flow compressor/turbine permanent magnet motor/generator 15 and a fluid outlet 16 to remove fluid from the helical flow compressor/turbine 17 of the helical flow compressor/turbine permanent magnet motor/generator 15. The helical flow machine is referred to as a compressor/turbine since it can function as both a compressor and as a turbine. The permanent magnet machine is referred to as a motor/generator since it can function equally well as a motor to produce shaft horsepower or as a generator to produce electrical power.

The helical flow compressor/turbine permanent magnet motor/generator 15 includes a shaft 20 rotatably supported by duplex ball bearings 21 and 31 at one end and single ball bearing 22 at the opposite end. The bearings are disposed on either side of low pressure stage impeller 24 and high pressure stage impeller 23 mounted at one end of the shaft 20, while permanent magnet motor/generator rotor 27 is mounted at the opposite end thereof. The duplex ball bearings 21 and 31 are held by bearing retainer 28, while single ball bearing 22 is disposed between high pressure stator channel plate 32 and the shaft 20. Both the low pressure stage impeller 24 and high pressure stage impeller 23 include a plurality of blades 26.

Low pressure stripper plate 37 and high pressure stripper plate 36 are disposed radially outward from low pressure impeller 24 and high pressure impeller 23, respectively. Following the general description, it will be explained that the stripper plates 36,37 have been modified in accordance with the present invention.

The permanent magnet motor/generator rotor 27 on the shaft 20 is disposed to rotate within permanent magnet motor/generator stator 48 which is disposed in the permanent magnet housing 49. The low pressure impeller 24 is disposed to rotate between the low pressure stator channel plate 34 and the mid-stator channel plate 33, while the high pressure impeller 23 is disposed to rotate between the mid-stator channel plate 33 and the high pressure stator channel plate 32. Low pressure stripper plate 37 has a thickness slightly greater than the thickness of low pressure impeller 24 to provide a running clearance for the low pressure impeller 24 between low pressure stator channel plate 34 and mid-stator channel plate 33, while high pressure stripper plate 36 has a thickness slightly greater than the thickness of high pressure impeller 23 to provide a running clearance for the high pressure impeller 23 between mid-stator channel plate 33 and high pressure stator channel plate 32.

The low pressure stator channel plate 34 includes a generally horseshoe-shaped fluid flow stator channel 42 having an inlet to receive fluid from the fluid inlet 56. The mid-stator channel plate 33 includes a low pressure generally horseshoe-shaped fluid flow stator channel 41 on the low pressure side thereof and a high pressure generally horseshoe-shaped fluid flow stator channel 40 on the high pressure side thereof. The low pressure generally horseshoe-shaped fluid flow stator channel 41 on the low pressure side of the mid-stator channel plate 33 mirrors the generally horseshoe-shaped fluid flow stator channel 42 in the low pressure stator channel plate 34. The high pressure stator channel plate 32 includes a generally horseshoe-shaped fluid flow stator channel 38 which mirrors the high pressure generally horseshoe-shaped fluid flow stator channel 40 on the high pressure side of mid-stator channel plate 33.

Each of the stator channels includes an inlet and an outlet disposed radially outward from the channel. The inlets and outlets of the low pressure stator channel plate generally horseshoe-shaped fluid flow stator channel 42 and mid-helical flow stator channel plate low pressure generally horseshoe-shaped fluid flow stator channel 41 are axially aligned as are the inlets and outlets of mid-helical flow stator channel plate high pressure generally horseshoe-shaped fluid flow stator channel 40 and high pressure stator channel plate generally horseshoe-shaped fluid flow stator channel 38.

The fluid inlet 18 extends through the high pressure stator channel plate 32, high pressure stripper plate 36, and mid-stator channel plate 33 to the inlets of both of low pressure stator channel plate generally horseshoe-shaped fluid flow stator channel 42 and mid-helical flow stator channel plate low pressure generally horseshoe-shaped fluid flow stator channel 41. The fluid inlet 18 extends from the outlets of both the mid-helical flow stator channel plate high pressure generally horseshoe-shaped fluid flow stator channel 40 and high pressure stator channel plate generally horseshoe-shaped fluid flow stator channel 38, through the high pressure stripper plate 36, and through the high pressure stator channel plate 32.

The cross-over from the low pressure compression stage to the high pressure compression stage is illustrated in FIG. 6. Both of the outlets from the low pressure stator channel plate generally horseshoe-shaped fluid flow stator channel 42 and mid-helical flow stator channel plate low pressure generally horseshoe-shaped fluid flow stator channel 41 provide partially compressed fluid to the cross-over 88 which, in turn, provides the partially compressed fluid to both inlets of mid-helical flow stator channel plate high pressure generally horseshoe-shaped fluid flow stator channel 40 and high pressure stator channel plate generally horseshoe-shaped fluid flow stator channel 38.

The impeller blades or buckets are best illustrated in FIGS. 7 and 8. The radial outward edge of the impeller 23 includes a plurality of low pressure blades 26. While these blades 28 may be radially straight as shown in FIG. 7, there may be specific applications and/or operating conditions where curved blades may be more appropriate or required.

FIG. 8 illustrates a portion of a helical flow compressor/turbine impeller having a plurality of curved blades 44. The curved blade base or root 45 has less of a curve than the leading edge 46 thereof. The curved blade tip 47, at both the root 45 and leading edge 46 would be generally radial.

The fluid flow stator channels are best illustrated in FIG. 9, which shows the mid-stator channel plate 33. The generally horseshoe-shaped stator channel 41 is shown along with inlet 55 and outlet 56. The inlet 55 and outlet 56 would normally be displaced approximately 30°. Outlet 56 connects with cross-over 58. An alignment or locator hole 57 is provided in each of the low pressure stator channel plate 34, the mid-stator channel plate 33, and the high pressure stator channel plate 32, as well as stripper plates 37 and 36. The inlet 55 is connected to the generally horseshoe-shaped stator channel 40 by a converging nozzle passage 51, but converts fluid pressure energy into fluid velocity energy. Likewise, the other end of the generally horseshoe-shaped stator channel 40 is connected to the outlet 56 by a diverging diffuser passage 52 that converts fluid velocity energy into fluid pressure energy.

The depth and cross-sectional flow area of fluid flow stator channel 40 are tapered preferably so that the peripheral flow velocity need not vary as fluid pressure and density vary along the fluid flow stator channel. When compressing, the depth of the fluid flow stator channel 40 decreases from inlet to outlet as the pressure and density increases. Converging nozzle passage 41 and diverging diffuser passage 42 allow efficient conversion of fluid pressure energy into fluid velocity energy and vice-versa.

FIG. 10 shows the flow through the impeller blades and the fluid flow stator channels by means of streamlines 53. FIG. 11 schematically illustrates the helical flow around the centerline of the impeller and fluid flow stator channel. The turning of the flow is illustrated by the alternating solid and open flow pattern lines in FIG. 11.

In a helical flow compressor/turbine, fluid enters the inlet port 18, and is accelerated as it passes through the converging nozzle passage 51, splits into two flow paths (formerly by a radial flow splitter), then enters the end of the generally horseshoe-shaped fluid flow stator channels 41 and 42 axially adjacent to the low pressure impeller blades 26. The fluid is then directed radially inward to the root of the impeller blades 26 by a pressure gradient, accelerated through and out of the blades 26 by centrifugal force, from where it reenters the fluid flow stator channel. During this time, the fluid has been traveling tangentially around the periphery of the helical flow compressor/turbine. As a result of this, helical flow is established as best shown in FIGS. 7, 10 and 11.

While the duplex ball bearings 21 and 23 are illustrated on the permanent magnet motor/generator end of the helical flow compressor/turbine and the single ball bearing 22 is illustrated at the opposite end of the helical flow compressor/turbine, their positions can readily be reversed with the single ball bearings 22 at the permanent magnet motor/generator end of the helical flow compressor/turbine and the duplex ball bearings 21 and 31 at the opposite end of the helical flow compressor/turbine. Likewise, while the low pressure impeller 24 is shown at the permanent magnet motor/generator end of the helical flow compressor/turbine and the high pressure impeller 23 at the opposite end, their relative positions can also be readily reversed.

Returning to FIG. 4, prior art helical flow compressors included a stripper plate 37' with a radial flow splitter 39' positioned between the stator channels 41,42 to split the fluid into two flow paths. Surprisingly, it has been discovered that the radial flow splitter 39' shown in FIG. 4 is not needed, and has therefore been eliminated, as shown in FIG. 5.

Accordingly, a radial gap (g) is provided between the periphery 60 of the impeller blades 26 and the radially inboard side 62 of the stripper plate 37, which is part of the compressor/turbine housing. This radial gap (g), shown in FIG. 5, allows increased fluid flow around the periphery 60 of the impeller blades 26 to minimize the pressure differential across the impeller 24, thereby reducing thrust loads acting upon the impeller 24.

The radial gap (g) is preferably between approximately 0.047 and 0.049 inch. The radial gap (g) is preferably proportional to the impeller's bucket depth (i.e., the impeller blade length) and can be unrelated to the impeller diameter.

Another feature of the invention is illustrated in FIGS. 2, 3, 5 and 6. As shown, each impeller 23,24 includes a pattern of axially-oriented vent holes 64,66 therethrough in order to provide fluid communication between opposing sides of the impeller wheels to reduce the pressure differential across the impeller wheels, and thereby reduce the thrust load applied to the impeller wheels, the shaft, and bearings.

Turning to FIG. 17, a perspective view of the impeller 24 is shown, illustrating the axial holes 66 therein.

FIGS. 18 and 19 show an alternative impeller 70 having three rows of differently sized axial holes 72,74,76. Preferably, the larger holes 72 are positioned near the center of the impeller 70, and the smaller holes 76 are positioned near the periphery of the impeller 70. Also, each hole 72,74,76 includes a chamfer 78,80,82 to reduce local pressure drop where fluid enters or exits the holes. A ratio of the hole diameter (d) to outer chamfer diameter (c) is optimized to minimize flow restrictions and minimize vent hole volume. This optimization is effected by wheel-to-housing axial clearance, which is commonly 0.005 inch adjacent each face of the impeller.

The present invention is applicable to single impeller flow machines, as well as two-stage, three-stage, four-stage, etc. flow machines. FIGS. 12–15 illustrate features of the present invention incorporated in a four-stage helical flow compressor/turbine permanent magnet motor/generator 90 in accordance with a second embodiment of the invention.

The four-stage helical flow compressor/turbine permanent magnet motor/generator 90 shown in FIGS. 12–15 is in all respects generally similar to the two-stage machine described previously with reference to FIGS. 1–11 except for the addition of third and fourth impellers, and items associated with such structure. The details of the structure and functionality of such a four-stage helical flow compressor/turbine permanent magnet motor/generator is also described in commonly assigned U.S. patent application Ser. No. 09/295,238, which is hereby incorporated by reference in its entirety. The details thereof will not be repeated here. Rather, distinguishing features of the invention will be described.

Accordingly, FIGS. 12, 13 and 14 show a four-stage helical flow compressor/turbine permanent magnet motor/generator 90 having four impellers 92,94,96,98 within a housing 100. Similarly to the embodiment described above with reference to FIGS. 1–3 and 5–11, a radial gap (g), shown in FIG. 13, is implemented between the periphery of each impeller 92,94,96,98 and the corresponding inner surface 102,104,106,108 of the housing 100. As described with reference to the earlier embodiment, the gap (g) is operative to minimize the pressure differential across each impeller 92,94,96,98, thereby reducing thrust loads acting upon each impeller.

In order to further reduce such thrust loads, leakage between the four stages of the motor/generator 90 is reduced by providing stainless steel labyrinth seals 110,112,114,116 between each impeller, and between the high pressure impeller 98 and the thrust disk 118. One such labyrinth seal 110 is illustrated in FIG. 15 and includes a central aperture 120 to receive the compressor shaft 122. A plurality of spaced rings 124 provide a near perfect seal between adjacent impellers by requiring fluid traveling therethrough to expand and compress multiple times before bypassing the seal. The rings 124 are preferably approximately 0.005 inch wide at their respective tips with a 15° to 20° taper angle, and spacing between rings of approximately 10 times the width of the rings. These labyrinth seals minimize flow leakage between compressor stages, thereby further minimizing pressure differential across each impeller to further minimize thrust load applied to the wheels, the shaft and the bearings.

As shown in FIG. 13, a plurality of vent holes 126 (only one is shown) are formed through the bottom part 128 of the housing 100 adjacent the air bearing 130 and arranged symmetrically with respect to the shaft 122, thereby communicating the low pressure stage associated with impeller 92 with the outside of the housing 128 to bypass the air bearing 130, thereby reducing the pressure differential across the air bearing 130. Accordingly, the undesired flow of gaseous process fluid through the bearing 130 adjacent the motor 132 is minimized when gas pressure at the compressor inlet changes, gas pressure at the compressor outlet changes, compressor speed changes, turbogenerator speed changes, or turbogenerator power operating level changes.

FIG. 16 shows a four-stage helical flow compressor/turbine permanent magnet motor/generator 140 in accordance with a third embodiment of the invention. This embodiment is in most respects similar to the embodiment shown in FIG. 13 except that the air bearings have been replaced by roller bearings 142,144. A plurality of bypass vents 146 are provided to reduce fluid flow through the roller bearings 142,144. The bypass vents 146 also prevent grease from being forced out of the roller bearings 144 by movement of fluid through the bearings 144. Also, labyrinth seals 148 are provided to minimize leakage between impellers, and a radial gap (g) is provided between the periphery of the impellers 150,152,154,156 and the inward-facing surface of the flow splitters 158,160,162,164 to balance pressures on opposing sides of the impellers 150,152,154,156. Axial holes 151,153,155 are provided through the impellers to further balance pressures on opposing sides of the impellers 150,152,154,156 to reduce axial forces on the impellers.

These features provide the same benefits as described above with reference to the earlier embodiments. Also, the various aspects of the invention may be provided in various combinations in any sized rotary machine (one-stage to four-stage).

While the best modes for carrying out the invention have been described in detail, those familiar with the art to which this invention relates will recognize various alternative designs and embodiments for practicing the invention within the scope of the appended claims.

What is claimed is:

1. A rotary machine including a helical flow compressor/turbine and a permanent magnet motor/generator, comprising:

a housing including a stator positioned therein;

a shaft rotatably supported within said housing;

a permanent magnet rotor mounted on said shaft and operatively associated with said stator; and an impeller mounted on said shaft, said impeller having an impeller disk with a plurality of impeller blades extending therefrom, said housing including a generally horseshoe-shaped fluid flow stator channel with an inlet at a first end and an outlet at a second end, the fluid in said generally horseshoe-shaped fluid flow stator channel proceeding from said inlet to said outlet while following a generally helical flow path with multiple passes through the impeller blades, wherein said impeller disk has a plurality of axially-oriented vent holes formed therethrough to minimize a pressure differential across the impeller, thereby minimizing thrust loads applied to the impeller, and wherein said axially-oriented vent holes comprise a plurality of small vent holes and a plurality of large vent holes arranged in a manner such that the smaller holes are positioned near the impeller blades and the larger holes are positioned near the center of the impeller.

2. The rotary machine of claim 1, wherein said shaft is rotatably supported by bearings, and said minimizing of thrusts loads improves bearing life.

3. The rotary machine of claim 2, wherein said bearings are roller bearings.

4. The rotary machine of claim 2, wherein said bearings are air bearings.

5. The rotary machine of claim 1, wherein said vent holes are chamfered to reduce local pressure drop where fluid enters or exits the holes.

6. The rotary machine of claim 5, wherein a ratio of hole diameter to outer chamfer diameter is optimized to minimize flow restrictions and minimize vent hole volume.

7. The rotary machine of claim 1, wherein no radial flow splitter is provided on the housing adjacent the periphery of the impeller blades thereby providing a radial gap between the periphery of the blades and the housing to allow increased flow around the periphery of the impeller blades to further minimize the pressure differential across the impeller.

8. The rotary machine of claim 7, wherein said radial gap is between approximately 0.047 and 0.049 inch.

9. The rotary machine of claim 2, wherein said housing includes at least one bypass vent formed through the housing adjacent to one of said bearings for providing fluid communication between opposing sides of the bearing to minimize axial thrust loads on the bearing.

10. The rotary machine of claim 9, wherein said bearings comprise roller bearings.

11. A multi-stage helical flow compressor, comprising:

a housing including a stator positioned therein;

a shaft rotatably supported within said housing;

a permanent magnet rotor mounted on said shaft and operatively associated with said stator; and a plurality of impellers mounted on said shaft, said impellers each having an impeller disk with two rows of impeller blades extending therefrom, said housing including a generally horseshoe-shaped fluid flow stator channel operably associated with each row of impeller blades, with an inlet at a first end and an outlet at a second end of each stator channel, the fluid in said generally horseshoe-shaped fluid flow stator channels proceeding from said inlets to said outlets while following a generally helical flow path with multiple passes through the impeller blades, wherein at least one of said impeller disks has a plurality of axially oriented vent holes formed therethrough to minimize a pressure differential across the respective impeller, thereby minimizing thrust loads applied to the respective impeller, and wherein said vent holes are chamfered to reduce local pressure drop where fluid enters or exits the holes.

12. The multi-stage helical flow compressor of claim 11, further comprising a labyrinth seal disposed between at least two of said plurality of impellers.

13. The multi-stage helical flow compressor of claim 12, wherein said labyrinth seal comprises a cylindrical member having a plurality of spaced-apart rings extending therefrom.

14. The multi-stage helical flow compressor of claim 11, wherein said shaft is rotatably supported by bearings, and said minimizing of thrusts loads improves bearing life.

15. The multi-stage helical flow compressor of claim 14, wherein said bearings are roller bearings.

16. The multi-stage helical flow compressor of claim 14, wherein said bearings are air bearings.

17. The multi-stage helical flow compressor of claim 11, wherein a ratio of hole diameter to outer chamfer diameter is optimized to minimize flow restrictions and minimize vent hole volume.

18. The multi-stage helical flow compressor of claim 11, wherein no radial flow splitter is provided on the housing adjacent to the periphery of the impeller blades of each impeller, thereby providing a radial gap between the periphery of the blades and the housing to allow increased flow around the periphery of the impeller blades to further minimize the pressure differential across each impeller.

19. The multi-stage helical flow compressor of claim 18, wherein said radial gap is between approximately 0.047 and 0.049 inch.

20. The multi-stage helical flow compressor of claim 14, wherein said housing includes at least one bypass vent formed through the housing adjacent to one of said bearings for providing fluid communication between opposing sides of the bearing to minimize axial thrust loads on the bearing.

21. The multi-stage helical flow compressor of claim 20, wherein said bearings comprise roller bearings.

22. A multi-stage helical flow compressor, comprising:

a housing including a stator positioned therein;

a shaft rotatably supported within said housing;

a permanent magnet rotor mounted on said shaft and operatively associated with said stator;

a plurality of impellers mounted on said shaft, said impellers each having an impeller disk with two rows of impeller blades extending therefrom, said housing including a generally horseshoe-shaped fluid flow stator channel operably associated with each row of impeller blades, with an inlet at a first end and an outlet at a second end of each stator channel, the fluid in said generally horseshoe-shaped fluid flow stator channels proceeding from said inlets to said outlets while following a generally helical flow path with multiple passes through the impeller blades; and a labyrinth seal disposed between at least two of said plurality of impellers, wherein at least one of said impeller disks has a plurality of axially-oriented vent holes formed therethrough to minimize a pressure differential across the respective impeller, thereby minimizing thrust loads applied to the respective impeller, and wherein said labyrinth seal comprises a cylindrical member having a plurality of spaced-apart rings extending therefrom.

23. The multi-stage helical flow compressor of claim 22, wherein said shaft is rotatably supported by bearings, and said minimizing of thrusts loads improves bearing life.

24. The multi-stage helical flow compressor of claim 23, wherein said bearings are roller bearings.

25. The multi-stage helical flow compressor of claim 23, wherein said bearings are air bearings.

26. The multi-stage helical flow compressor of claim 22, wherein said vent holes are chamfered to reduce local pressure drop where fluid enters or exits the holes.

27. The multi-stage helical flow compressor of claim 26, wherein a ratio of hole diameter to outer chamfer diameter is optimized to minimize flow restrictions and minimize vent hole volume.

28. The multi-stage helical flow compressor of claim 22, wherein no radial flow splitter is provided on the housing adjacent to the periphery of the impeller blades of each impeller, thereby providing a radial gap between the periphery of the blades and the housing to allow increased flow around the periphery of the impeller blades to further minimize the pressure differential across each impeller.

29. The multi-stage helical flow compressor of claim 28, wherein said radial gap is between approximately 0.047 and 0.049 inch.

30. The multi-stage helical flow compressor of claim 23, wherein said housing includes at least one bypass vent formed through the housing adjacent to one of said bearings for providing fluid communication between opposing sides of the bearing to minimize axial thrust loads on the bearing.

31. The multi-stage helical flow compressor of claim 30, wherein said bearings comprise roller bearings.

32. A rotary machine including a helical flow compressor/turbine and a permanent magnet motor/generator, comprising:

a housing including a stator positioned therein;

a shaft rotatably supported within said housing;

a permanent magnet rotor mounted on said shaft and operatively associated with said stator; and an impeller mounted on said shaft, said impeller having an impeller disk with a plurality impeller blades extending therefrom, said housing including a generally horseshoe-shaped fluid flow stator channel with an inlet at a first end and an outlet at a second end, the fluid in said generally horseshoe-shaped fluid flow stator channel proceeding from said inlet to said outlet while following a generally helical flow path with multiple passes through the impeller blades, wherein no radial flow splitter is provided on the housing adjacent to the periphery of the impeller blades thereby providing a radial gap between the periphery of the blades and the housing to allow increased flow around the periphery of the impeller blades to minimize a pressure differential across the impeller, thereby minimizing thrust loads applied to the impeller.

33. The rotary machine of claim 32, wherein said impeller disk has a plurality of axially-oriented vent holes formed therethrough to further minimize the pressure differential across the impeller.

34. The rotary machine of claim 32, wherein said shaft is rotatably supported by bearings, and said minimizing of thrusts loads improves bearing life.

35. The rotary machine of claim 34, wherein said bearings are roller bearings.

36. The rotary machine of claim 34, wherein said bearings are air bearings.

37. The rotary machine of claim 33, wherein said vent holes are chamfered to reduce local pressure drop where fluid enters or exits the holes.

38. The rotary machine of claim 37, wherein a ratio of hole diameter to outer chamfer diameter is optimized to minimize flow restrictions and minimize vent hole volume.

39. The rotary machine of claim 32, wherein said radial gap is between approximately 0.047 and 0.049 inch.

40. The rotary machine of claim 34, wherein said housing includes at least one bypass vent formed through the housing adjacent to one of said bearings for providing fluid communication between opposing sides of the bearing to minimize axial thrust loads on the bearing.

41. The rotary machine of claim 40, wherein said bearings comprise roller bearings.

42. A method of reducing thrust loads in a rotary machine including a helical flow compressor/turbine and a permanent magnet motor/generator having a housing with a stator position therein, a shaft rotatably supported within the housing, a permanent magnet rotor mounted on the shaft and operatively associated with the stator, and an impeller mounted on the shaft, said impeller having an impeller disk with a plurality of impeller blades extending therefrom, said housing including a generally horseshoe shaped fluid flow stator channel with an inlet at a first end and an outlet at a second end, the fluid in said generally horseshoe shaped fluid flow stator channel preceding from said inlet to said outlet while following a generally helical flow path with multiple passes through the impeller blades, the method comprising:

providing a radial gap of between approximately 0.047 and 0.049 inch between the periphery of blades and the housing to allow increased flow around the periphery of the impeller blades to minimize a pressure differential across the impeller, thereby minimizing thrust loads applied to the impeller.

* * * * *

UNITED STATES PATENT AND TRADEMARK OFFICE

CERTIFICATE OF CORRECTION

PATENT NO. : 6,709,243 B1
DATED : March 23, 2004
INVENTOR(S) : Tan et al.

It is certified that error appears in the above-identified patent and that said Letters Patent is hereby corrected as shown below:

Column 13,
Line 47, please replace "plurality impeller" with -- plurality of impeller --.

Signed and Sealed this

Nineteenth Day of October, 2004

JON W. DUDAS
*Director of the United States Patent and Trademark Office*